United States Patent [19]

Kretzschmann et al.

[11] 4,431,392

[45] Feb. 14, 1984

[54] APPARATUS FOR EXTRUDING CONCRETE

[75] Inventors: Volker Kretzschmann, Gaggenau; Peter Traub, Gernsbach, both of Fed. Rep. of Germany

[73] Assignee: Roth-Technick GmbH, Gaggenau, Fed. Rep. of Germany

[21] Appl. No.: 392,799

[22] Filed: Jun. 28, 1982

[30] Foreign Application Priority Data

Jul. 8, 1981 [DE] Fed. Rep. of Germany ..... 3126951

[51] Int. Cl.[3] ..... B28B 1/08

[52] U.S. Cl. ..... 425/64; 425/62; 425/218; 264/70

[58] Field of Search ..... 425/88, 218, 458, 404, 425/134, 220, 62, 64; 264/70

[56] References Cited

U.S. PATENT DOCUMENTS

| | | | |
|---|---|---|---|
| 3,201,845 | 8/1965 | Strong | 425/218 |
| 3,217,375 | 11/1965 | Kinnard | 425/218 |
| 4,259,050 | 3/1981 | Borcoman | 425/88 |

FOREIGN PATENT DOCUMENTS 1946636 3/1971 Fed. Rep. of Germany .

*Primary Examiner*—Thomas P. Pavelko
*Attorney, Agent, or Firm*—Robert S. Lipton

[57] ABSTRACT

An apparatus for use in manufacturing concrete parts or products is disclosed. The apparatus for extruding concrete, of the present invention, includes a first frame which is adapted to travel on tracks. A second frame is mounted on top of the first frame by removable fasteners so that the second frame may be disconnected from the first frame. The first frame includes wheels so that it may travel along the track.

7 Claims, 1 Drawing Figure

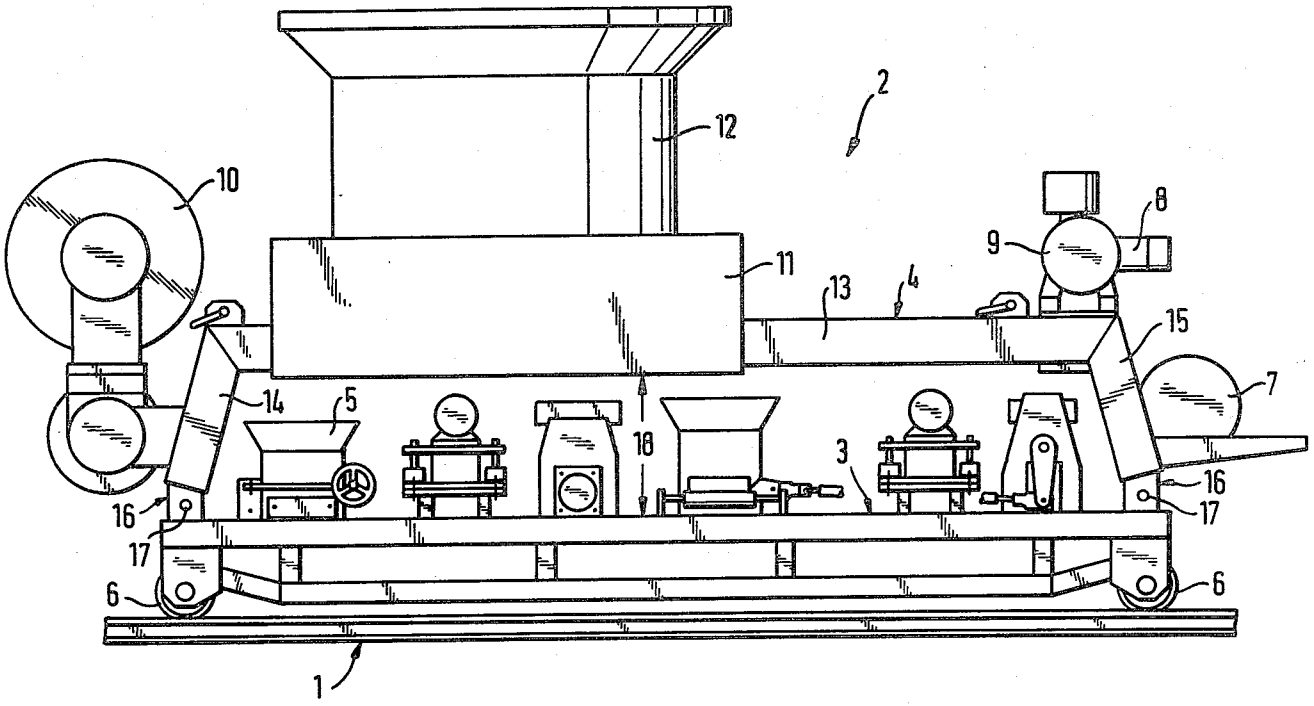
1
2
3
4
5
6
7
8
9
10
11
12
13
14
15
16
17
18

APPARATUS FOR EXTRUDING CONCRETE

BACKGROUND OF THE INVENTION

This invention generally relates to machines for extruding concrete. In particular, this machine relates to machines of the type which form reinforced concrete parts, such as structural beams and the like.

Machines of this general type, in operation, move horizontally over a work surface. As they move horizontally concrete is forced or extruded through a distribution box and a mold before being deposited on the work surface. Reinforcement material, such as metal rods, may be appropriately oriented on the work surface when reinforced concrete parts are being manufactured.

The shape of the parts which are being manufactured are being controlled by a set of molding boxes. The distribution boxes are devices for feeding and compacting the concrete. The condensing, or compacting of the concrete may be accomplished by vibrators which are connected to, or which form part of, the distribution boxes. Such concrete extruding machines also include a motor for moving the machine horizontally over the work surface. The various systems of such machines are hydraulically and electrically operated. Accordingly, such machines include devices for handling and storing the electrical and hydraulic cables.

Such a concrete extruding machine is shown in DE-AS 19 46 636. A first frame is provided which is equipped with the appropriate devices for the feeding and compaction of the concrete, for example, concrete distribution boxes. A second frame which is connected to the first frame is equipped with the hydraulic cable drive devices, the drum for the electrical supply cable, the motor for moving the core, molding boxes, as well as for the powering of the concrete distributor boxes. The second frame also includes the electrical equipment, such as a high frequency voltage transformer, control board with its associated wiring, and individual electrical outlets to which the various electrically operated components are connected. Both frames can be moved in unison on rails by means of wheels.

In this prior art device, the second frame is mounted on top of the first frame. This prior art device has, in general, worked well. Since the first frame is mounted on top of the second frame, it has been necessary to provide an open area in the configuration of the second frame so that the distribution and molding boxes may deposit the concrete on the work surface. This requirement has, in turn, made it necessary that the devices and apparatus that are mounted on the second frame be mounted in the forward and rear areas of the frame, thereby resulting in a long device with all its resultant disadvantages. This very long device requires additional structural support to provide assurance that the longitudinal beams which make up the frame do not bend, thereby resulting in increased weight. A further disadvantage of such a machine results from the fact that the elevated cross beams of the second frame control the maximum height of the parts which are to be manufactured by the machine. Although a wide variety of finished parts may be manufactured by changing or using another first frame, it cannot produce parts which would exceed the maximum height which is controlled by the second frame. Additionally, this prior art machine requires a great deal of time to change the tooling which is required in order to manufacture a different part, since first the hopper for containing the concrete has to be removed. After the removal of the hopper, the first frame has to be removed from the second frame and replaced by another one. Finally, the hopper has to be remounted to the replacement first frame.

SUMMARY OF THE INVENTION

Accordingly, it is an object of the present invention to provide a machine for extruding concrete parts wherein the height of the parts to be manufactured is not limited by the machine.

It is a further object of the present invention to provide a machine for extruding concrete parts that requires minimal time in which to change tooling.

It is still another object of the present invention to provide a machine for extruding concrete parts wherein the length of said machine is considerably shorter, requiring less structural supports and, hence, less weight.

The present invention overcomes the problems associated with the prior art devices by providing a machine in which the second frame is so designed that it can be placed on top of the first frame. The second frame is connected to the first frame by removable fasteners so that it may quickly and easily be removed from the first frame during tooling changes. Thus, the second frame with its electrical and hydraulic devices and motor is placed on top of the first frame having the concrete distribution and molding boxes. The second frame may have its components overhang the first frame, or be placed over the first frame. In either case, a comparatively short assembly length results in a compact and relatively lightweight machine.

Furthermore, the maximum height of the finished parts which are to be manufactured by the machine is no longer limited, since the second frame is mounted on top of the first frame.

Changes in production tooling may be quickly accomplished by the present invention. This may be accomplished, for example, by one or more additional first frames being placed adjacent to the machine which is currently producing parts. While the machine is operating, the various tooling changes may be made to these additional first frames. When the production run is completed, the second frame may be quickly removed and placed on the waiting and adjacent additional first frame. Since the hopper is connected to the second frame, it no longer has to be removed and reconnected. Thus, a fully operational production unit is quickly and easily obtained. The second frame of this arrangement requires a crane with a relatively low load capacity, making it easy to reequip existing installations with this invention by simply exchanging production units. This invention assures that the height of the finished parts is unrestricted with a proper design of the first frame, and with a minimal machine down-time. A single second frame and a variety of first frames equipt for the production of a variety of finished parts is obtained. Thus the present invention provides the shortest possible time for the change in production tooling by requiring only a single step.

Other further objects and advantages of the present invention will become apparent from a consideration of the drawing, in which like numerals refer to like parts, and the discussion which follows.

BRIEF DESCRIPTION OF THE DRAWING

A side schematic view of the present invention is shown in the drawing.

DESCRIPTION OF THE PREFERRED EMBODIMENT

Referring now to the drawing, a machine 2 for extruding concrete parts is shown on a track 1. The machine 2 consists of a lower first frame 3 and an upper frame 4. Concrete distribution boxes 5 and other appropriate accessories for feeding and compacting the concrete are mounted on the first frame 3. These feeding and compacting accessories are well known in the prior art and, accordingly, are not described in detail. Connected to the first frame 3 at its forward and rearward ends are wheels 6 which roll on the track 1.

Mounted on the frame 4 is a hydraulically powered cable apparatus 7, a motor 8, and a high frequency and voltage transformer 9. Mounted on the other end of frame 4 is a drum 10 for the electrical supply cable. The electrically and hydraulically driven accessories mounted on frame 3 are connected, by means not shown, to the electrical and hydraulic apparatus connected to frame 4, thus forming an operational machine 2.

The upper frame 4 includes longitudinal beams 13, only one of which is shown. Connected to the beams 13 by removable fastners is a frame 11 which supports a hopper 12 for holding the concrete. The hopper 12 is connected to the frame 11 by removable fastners, not shown, so that it may be easily removed. The frame 11 and hopper 12 are mounted to the frame 13 in such a way as to create the best possible weight distribution.

The frame 4 has connected at its opposite ends trusses 14 and 15 which are connected to the beams 13. The opposite ends of the trusses 14 and 15 fit into pockets 16 which form a part of the lower frame 4. The trusses 14 and 15 are secured to the pocket 16 by removable bolts 17.

The height 18 between the first frame 3 and the second frame 4 is sufficient so that the accessories mounted to the first frame have sufficient space so as to not interfere with the second frame 4. This height is essentially constant even with various first frames. The change in tooling which is required to manufacture different concrete parts involves the changing of the molding boxes which are connected to the first frame. In the event the height of a particular finished product requires a molding box which cannot be connected to a particular first frame, an alternate first frame may then be used. With such a variety of first frames 3, the maximum height of the concrete parts or beams is unrestricted.

Wheels may be mounted to the ends of trusses 14 and 15 which are inserted into the pockets 16. These wheels will enable the beam 13 to be easily moved independently when it is not mounted to a first frame 3 and is resting either on the ground or on adjacent tracks. Additionally, each of the beams 13 of the frame 4 may be constructed of a pair of members wherein one member is slidably connected to the other, thereby enabling the length of frame 4 to be varied, thereby permitting it to accommodate first frames 3 of various lengths.

Although the present invention has been described with reference to the particular embodiment herein set forth, it is understood that the present disclosure has been made only by way of example and that numerous changes in the details of construction may be resorted to without departing from the spirit and scope of the invention. Thus, the invention should not be limited by the foregoing specification, but rather only by the scope of the claims appended hereto.

What is claimed is:

1. An apparatus for extruding concrete upon a work surface which comprises:

a first frame, including translation means adapted to be translationally moved over the work surface, said frame having connected thereto means for feeding and condensing concrete, means for shaping the extruded concrete upon the work surface, and support means; and a second frame adapted to be positioned above said first frame by resting upon said support means of said first frame, having connected thereto a motor, hydraulically powered cables, and a drum for the electrical supply cables; and a hopper connected to said second frame.

2. The apparatus of claim 1 wherein said translation means include wheels connected thereto thereby permitting the apparatus to move on tracks.

3. The apparatus of claim 1 wherein said second frame includes at each of its opposite ends a pair of substantially vertical support members adapted to engage said support means of said first frame.

4. The apparatus of claim 3 wherein said support means of said first frame and the lower ends of said support members are adapted to be detachably connected to each other, thereby permitting said second frame to be easily and quickly removed from said first frame.

5. The apparatus of claim 4 are connected by bolts.

6. The apparatus of claim 5 wherein the lower end of said vertical members have wheels connected at their lower end.

7. The apparatus of claim 1 wherein said second frame includes means enabling its length to be changed.

* * * * *